United States Patent [19]

Fukada

[11] Patent Number: 4,766,816

[45] Date of Patent: Aug. 30, 1988

[54] SYSTEM FOR MOVING ELECTRICAL EQUIPMENT

[75] Inventor: Kouichi Fukada, Kobe, Japan

[73] Assignee: Mitsubishi Denki Kabushiki Kaisha, Japan

[21] Appl. No.: 934,991

[22] Filed: Nov. 26, 1986

[30] Foreign Application Priority Data

Nov. 27, 1985 [JP] Japan ..... 60-265065

[51] Int. Cl.[4] ..... B61B 13/00

[52] U.S. Cl. ..... 104/172.4

[58] Field of Search ..... 104/172.4, 296, 140, 104/172.1, 139, 93, 90, 89, 118, 165; 105/150, 148, 35; 310/75 R, 83; 74/444; 180/165; 362/193

[56] References Cited

U.S. PATENT DOCUMENTS

| | | | |
|---|---|---|---|
| 1,040,443 | 10/1912 | Signor | 74/444 X |
| 1,348,822 | 8/1920 | Ricketts | 74/444 X |
| 2,115,135 | 4/1938 | Benbow | 104/89 X |
| 2,928,356 | 3/1960 | Tredwell | 104/89 |
| 3,678,861 | 7/1972 | Holbert | 104/172.4 |
| 4,073,237 | 2/1978 | Wakabayashi | 104/172.4 |
| 4,078,499 | 3/1978 | Giraud | 104/165 |
| 4,239,975 | 12/1980 | Chiappetti | 310/75 R X |
| 4,325,108 | 4/1982 | Spingler | 362/193 X |
| 4,475,075 | 10/1984 | Munn | 310/75 R X |
| 4,536,668 | 8/1985 | Boyer | 310/83 X |
| 4,696,236 | 9/1987 | Kanayama | 104/165 |

FOREIGN PATENT DOCUMENTS

| | | | |
|---|---|---|---|
| 2094736 | 9/1982 | United Kingdom | 104/172.4 |

OTHER PUBLICATIONS

"Tele-Operated Robot for Inspection Inside the PCV", Sadakane et al, Proceeding Conference Remote System Tech., 1982.

*Primary Examiner*—Robert B. Reeves
*Assistant Examiner*—Joseph D. Pape
*Attorney, Agent, or Firm*—Leydig, Voit & Mayer

[57] ABSTRACT

A system for moving a tele-operated car containing electrical equipment is disclosed herein which comprises a drive mechanism, a trolley chain continuously driven by the drive mechanism, a railway disposed along the trolley chain, a tele-operated car with a sprocket wheel engaging the trolley chain and a rail wheel engaging the railway, and a generator in the car for supplying electric power to the electrical equipment. The generator is selectively driven by the sprocket wheel when the car is stopped or the rail wheel when the car is moving.

9 Claims, 2 Drawing Sheets

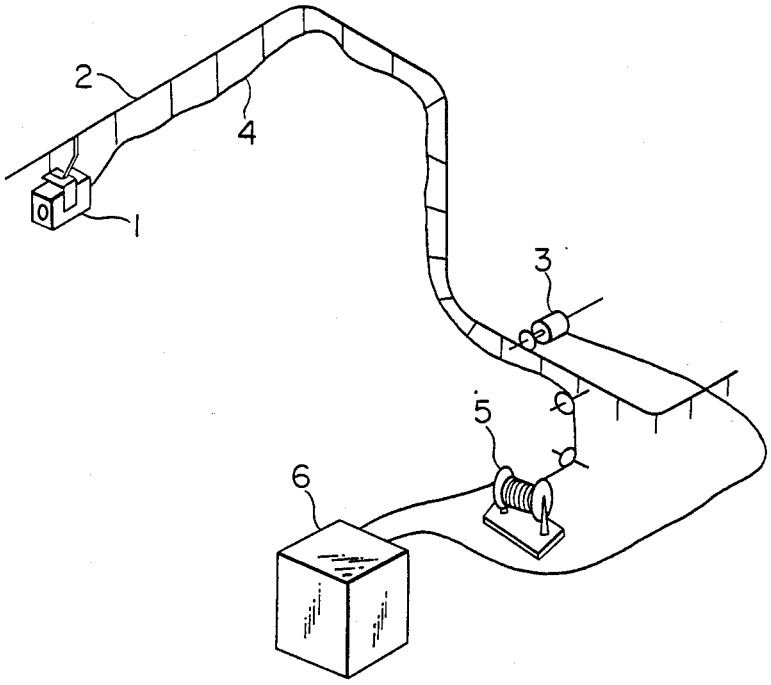
FIG. 2
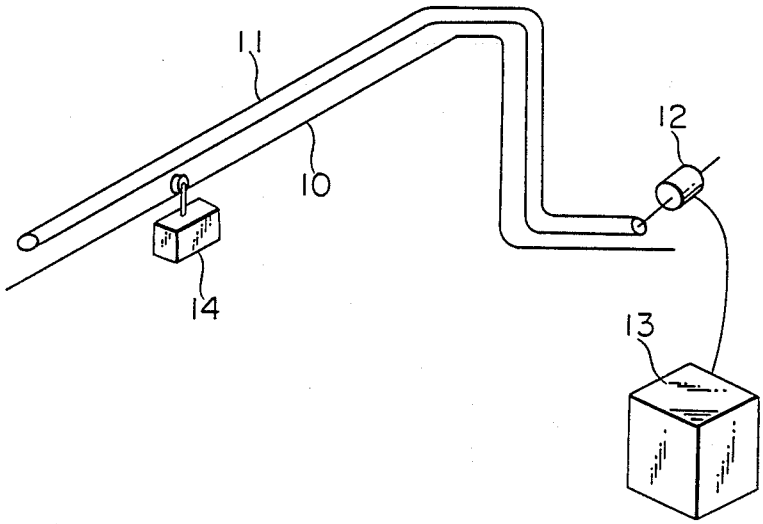

SYSTEM FOR MOVING ELECTRICAL EQUIPMENT

BACKGROUND OF THE INVENTION

The present invention relates to a system for moving electrical equipment and more particularly to a system for moving and operating tele-operated electrical equipment for inspecting the inside of a nuclear reactor containment vessel which can not be easily accessed.

FIG. 1 illustrates one example of a conventional system for moving a tele-operated car having electrical equipment mounted therein for monitoring various components disposed within the primary containment vessel of a nuclear reactor. The system is described in a review "THERMAL AND ATOMIC POWER GENERATION, Vol. 34, No. 3, pages 51 to 53, March, 1983, edited by Thermal and Atomic Power Generation Engineering Association.

The system comprises a tele-operated car 1 for carrying electric instruments or equipment (not shown) such as a camera and a thermometer which are mounted therein, a trolley chain 2, which supports the car 1, driven by a drive mechanism 3 for moving the car 1, a feed cable 4 for supplying the electrical equipment with electric power, one end of which is connected to the car 1 and the other of which is wound around a cable reel 5 which is rotated clockwise or counterclockwise in accordance with the direction of movement of the car 1 to extend or rewind the cable 4, an electric power source 6 connected both to the drive mechanism 3 and the cable reel 5 to supply electric power thereto as well as to the electric equipment mounted in the car 1 through the cable 4 and the cable reel 5.

As has been described above, the conventional system for moving the car 1 uses the feed cable 4 supported by the trolley chain 2 for supplying the electric power to the electric equipment mounted in the car 1. Accordingly, it is indispensable that the system is provided with the cable reel 5 for extending and rewinding the cable 4. Besides, the system has the problems that, when the tele-operated car 1 is moved over a long distance, the cable 4 must also be long which causes the movement of the car 1 to become unstable as well as making it difficult to travel especially around a given portion of the trolley chain 2.

SUMMARY OF THE INVENTION

Accordingly, an object of the present invention is to provide a system for moving a tele-operated car having electrical equipment provided therein with a generator free from the above described problems.

In order to accomplish the object, the system according to the present invention comprises a car which travels on a railway disposed along a trolley chain. The car comprises a wheel which freely rolls on the railway, a sprocket wheel adapted to be engaged with the trolley chain, an AC generator for generating electric power and rotation transmitting means, to which the rotation of any one of the wheel and the sprocket wheel is selectively transmitted, for transmitting the rotation to the generator, when one of the wheel and the sprocket wheel is rotated.

BRIEF DESCRIPTION OF THE DRAWINGS

The present invention will become more readily apparent from the following detailed description of the preferred embodiment of the invention taken in conjunction with the accompanying drawings, in which:

FIG. 1 is a schematic diagram of one example of the conventional systems for moving electrical equipment;

FIG. 2 is a schematic diagram of an arrangement of a system for moving electrical equipment according to one embodiment of the present invention.

DETAILED DESCRIPTION OF THE PREFERRED EMBODIMENT

Figure 3:
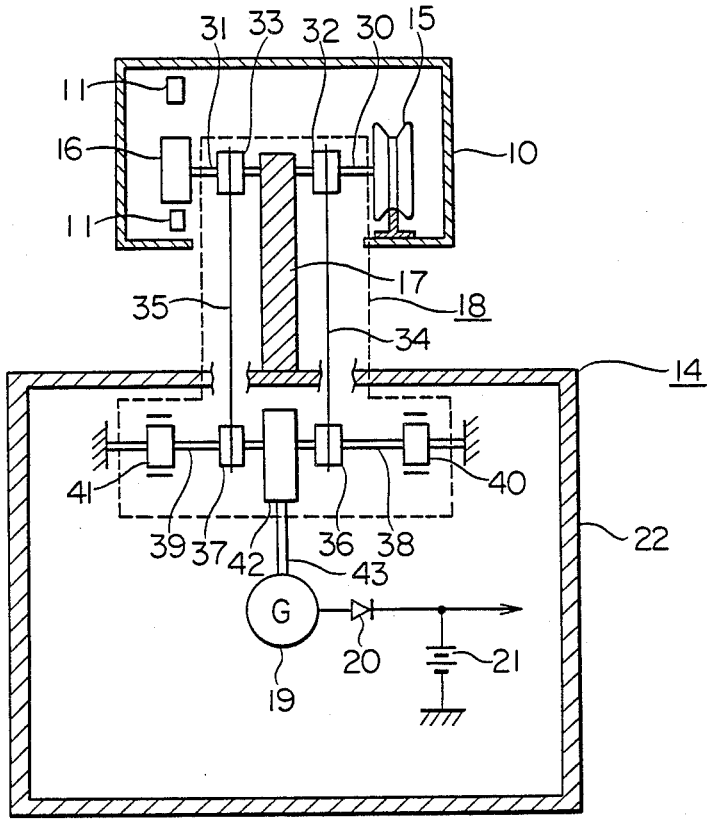
FIG. 3 is a schematic cross-sectional view of a tele-operated car according to the present invention.

Referring now to FIG. 2, the system for moving electrical equipment of the present invention comprises a railway 10, a trolley chain 11 disposed along the railway 10, a drive mechanism 12 for driving the trolley chain 11, an electric power source 13 for supplying electric power to the drive mechanism 12, a tele-operated car 14, provided therein with electrical equipment (not shown).

Referring now to FIG. 3, the tele-operated car 14, in which unillustrated electrical equipment such as a TV camera is housed, comprises a wheel 15, a sprocket wheel 16 which is engaged with the trolley chain 11, a supporting arm 17 and a housing 22. One end of the supporting arm 17 rotatably supports the wheel 15 and sprocket wheel 16 through a first rotary shaft 30 and a second rotary shaft 31 and the other end is secured to the housing 22 of the car 14. The tele-operated car 14 further comprises an AC generator 19 for generating AC power and rotation transmitting means 18 for transmitting the rotation of any one of the wheel 15 and the sprocket wheel 16 to the generator 19. The output of the generator 19 is connected to a battery 21 via a diode 20 for rectifying the output thereof, the rectified output being supplied to the electrical equipment as well as to charge the battery 21.

The rotation transmitting means 18 comprises the first rotary shaft 30, one end of which is connected to the wheel 15 and the other end of which is rotatably mounted to the supporting arm 17, and the second rotary shaft 31, one end of which is connected to the sprocket wheel 16 and the other end of which is rotatably mounted to the supporting arm 17. The transmitting means 18 further comprises a first upper sprocket wheel 32 and a second upper sprocket wheel 33, both being secured respectively to the middle portions of the first rotary shaft 30 and the second rotary shaft 31, a first chain 34 and a second chain 35 respectively and a first lower sprocket wheel 36 and a second lower sprocket wheel 37, both being secured to a first input shaft 38 and a second input shaft 39, respectively. The rotation of the first and second upper sprocket wheels 32, 33 is transmitted to the first and second lower sprocket wheels 36, 37 through the first and second chains 34,35. One end of each of the first and second input shafts 38, 39 is connected to a first brake 40 and a second brake 41 and the other is connected to a differential gear 42. The generator 19 is driven by the differential gear 42 through an output shaft 43.

In the car moving system as above described, the trolley chain 11 is continuously driven by the drive mechanism 12 for driving the sprocket wheel 16. The rotation of the sprocket wheel 16 is transmitted to the second input shaft 39 of the differential gear 42 through the second rotary shaft 31, the second upper sprocket wheel 33, the second chain 35 and the second lower sprocket wheel 37 and further to the second brake 41.

On the other hand, the rotation of the wheel 15 is transmitted to the first input shaft 38 of the differential gear 42 through the first rotary shaft 30, the first upper sprocket wheel 32, the first chain 34 and the first lower sprocket wheel 36, and further to the first brake 40.

When the car 14 is to be moved, the second brake 41 is actuated and the first brake 40 is released. Thus, the second input shaft 39 is locked, thereby preventing the rotation of the sprocket wheel 16. Accordingly, the sprocket wheel 16 is pulled by the trolley chain 11, thus moving the car 14. Further, during this time the wheel 15, which rotatably engages the railway 10, rotates as the car 14 moves. The rotation of the wheel 15 is transmitted to the first input shaft 38 of the differential gear 42 through the first rotary shaft 30, the first upper sprocket wheel 32, the first chain 34, and the first lower sprocket wheel 36. Thus, the output shaft 43 of the differential gear 42 is rotated only by the first input shaft 38 to drive the generator 19.

When the car is to be stopped, the first brake 40 is actuated while the second brake 41 is released, whereby the first input shaft 38 is locked, preventing rotation of the wheel 15. At this time, since the second brake 41 is not actuated, the sprocket wheel 16 is rotated by the trolley chain 11. The rotation of the sprocket wheel 16 is transmitted to the second input shaft 39 of the differential gear 42 through the second rotary shaft 31, the second upper sprocket 33, the second chain 35, and the second lower sprocket wheel 37. Thus, the output shaft 43 of the differential gear 42 is driven only by the second input shaft 39 of the differential gear 42, thus rotating the generator 19.

Thus, the generator 19 is rotated by using the movement of the trolley chain 11 driven by the drive mechanism 12, either when the car 14 is moving or when it is stopped.

Although the differential gear 42 is used in the illustrated embodiment, it should be noted that a gear mechanism comprising a change-over clutch interconnected to the first and second brakes 40, 41 may be also used instead of the differential gear 42.

As can be seen from the foregoing description, the system for moving the tele-operated car having electrical equipment mounted therein according to the present invention comprises a generator which can be driven by the movement of the trolley chain, either when the car is moving or when it is stopped. This makes it possible to realize a low cost system which continuously supplies electric power produced by the generator to the electrical equipment mounted in the car as well as to move the car smoothly.

What is claimed is:

1. A system for moving electrical equipment comprising:

a drive mechanism;

a trolley chain driven by said drive mechanism;

a railway disposed along said trolley chain; and a tele-operated car carrying therein the electrical equipment, said car including a wheel which rolls on said railway, a sprocket wheel which is in engagement with said trolley chain, an electrical generator for supplying electric power to the electrical equipment, and rotation transmitting means for selectively transmitting the rotation of one of said wheel and said sprocket wheel to said generator.

2. A system for moving electrical equipment as claimed in claim 1 wherein said rotation transmitting means includes a differential gear, to which the rotation of said wheel and sprocket wheel is selectively transmitted, for driving said generator.

3. A system for moving electrical equipment as claimed in claim 1 wherein said tele-operated car further includes means for selectively braking said sprocket wheel.

4. A system for moving electrical equipment as claimed in claim 3 wherein said drive mechanism continuously drives said trolley chain.

5. A car for carrying electrical equipment and for moving along a railway via a trolley chain, said car comprising:

a housing assembly;

a sprocket wheel rotatably supported by said housing assembly and engaging the trolley chain;

a brake cooperatively arranged with said sprocket wheel for selectively braking said sprocket wheel;

a wheel rotatably supported by said housing assembly and rotatably engaging said railway;

an electrical generator for generating electric power for the electrical equipment; and means coupled to said wheel, said sprocket wheel, and said electrical generator for selectively transmitting rotation from one of said wheel and said sprocket wheel to said generator.

6. A car as claimed in claim 5 wherein said rotation transmitting means comprises first and second rotary shafts rotatably supported by said housing assembly and rotatably supporting said wheel and said sprocket wheel, respectively.

7. A car as claimed in claim 6 wherein said rotation transmitting means further comprises a differential gear having an output shaft coupled to the generator and first and second input shafts rotatably coupled between the differential gear and said first and second rotary shafts, respectively, and rotatably coupled to said electrical generator.

8. A car as claimed in claim 7 wherein said rotation transmitting means further comprises first and second upper sprocket wheels coupled to said first and second rotary shafts, respectively, first and second lower sprocket wheels coupled to said first and second input shafts, respectively, a first chain engaging said first upper sprocket wheel and said first lower sprocket wheel and rotatably coupling said first rotary shaft to said first input shaft, and a second chain engaging said second upper sprocket wheel and said second lower sprocket wheel and rotatably coupling said second rotary shaft to said second input shaft.

9. A car as claimed in claim 8 wherein said housing assembly comprises a housing and a supporting arm having first and second ends, said first end of said supporting arm being secured to said housing and said second end of said supporting arm rotatably supporting said first and second rotary shafts.

* * * * *